US007466273B2

(12) United States Patent
Lee et al.

(10) Patent No.: US 7,466,273 B2
(45) Date of Patent: Dec. 16, 2008

(54) MULTIBAND ANTENNA USING WHIP HAVING INDEPENDENT POWER FEEDING IN WIRELESS TELECOMMUNICATION TERMINAL

(75) Inventors: Jin-Woo Lee, Gyeonggi-do (KR); Sang-Hyuk Mun, Incheon (KR)

(73) Assignee: Ace Technology, Incheon (KR)

( * ) Notice: Subject to any disclaimer, the term of this patent is extended or adjusted under 35 U.S.C. 154(b) by 0 days.

(21) Appl. No.: 10/594,928

(22) PCT Filed: Mar. 31, 2004

(86) PCT No.: PCT/KR2004/000749

§ 371 (c)(1),
(2), (4) Date: Sep. 29, 2006

(87) PCT Pub. No.: WO2005/101572

PCT Pub. Date: Oct. 27, 2005

(65) Prior Publication Data

US 2007/0205948 A1 Sep. 6, 2007

(51) Int. Cl.
*H01Q 1/24* (2006.01)

(52) U.S. Cl. ..... 343/702; 343/893

(58) Field of Classification Search ..... 343/702, 343/895, 793, 901, 893; 455/90.3
See application file for complete search history.

(56) References Cited

U.S. PATENT DOCUMENTS

| | | | | |
|---|---|---|---|---|
| 6,069,592 | A * | 5/2000 | Wass | 343/895 |
| 6,239,755 | B1 * | 5/2001 | Klemens et al. | 343/702 |
| 6,295,462 | B1 * | 9/2001 | Kudoh | 455/41.3 |
| 6,380,903 | B1 * | 4/2002 | Hayes et al. | 343/725 |
| 6,388,626 | B1 | 5/2002 | Gamalielsson et al. | |
| 6,882,320 | B2 * | 4/2005 | Park et al. | 343/702 |
| 7,075,487 | B2 * | 7/2006 | Mattsson et al. | 343/702 |
| 7,228,112 | B2 * | 6/2007 | Ota et al. | 455/90.3 |
| 2003/0048227 | A1 | 3/2003 | Nakamura | |
| 2004/0095283 | A1 | 5/2004 | Park et al. | |

FOREIGN PATENT DOCUMENTS

| | | | |
|---|---|---|---|
| EP | 1 01 603 | A | 12/2000 |
| EP | 1 193 791 | A | 4/2002 |
| GB | 2347560 | | 9/2000 |
| KR | 10-2000-0021662 | A | 4/2000 |

OTHER PUBLICATIONS

Supplementary European Search Report dated Jun. 10, 2008.

* cited by examiner

*Primary Examiner*—Tan Ho
(74) *Attorney, Agent, or Firm*—Venable LLP; Michael A. Sartori; Catherine M. Voorhees

(57) ABSTRACT

Provided is a multi-band antenna using a whip having independent power feeding in a wireless telecommunication terminal. The multi-band antenna of a wireless telecommunication terminal includes a first feed point for feeding an electric signal provided from an electric signal provider; a second feed point for feeding an electric signal provided from the electric signal provider; a plurality of radiators for radiating the electric signal fed from the first feed point into an electromagnetic wave signal; and a whip radiator for radiating the electric signal fed from the second feed point into an electromagnetic wave signal in order to increase the radiant efficiency of the electromagnetic wave signal radiated from a plurality of radiator and extend a bandwidth.

18 Claims, 6 Drawing Sheets

MULTIBAND ANTENNA USING WHIP HAVING INDEPENDENT POWER FEEDING IN WIRELESS TELECOMMUNICATION TERMINAL

This application is a 371 of PCT/KR04/00749 filed on Mar. 31, 2004.

TECHNICAL FIELD

The present invention relates to a multi-band antenna using a whip having independent power feeding in a wireless telecommunication terminal: and, more particularly, to a multi-band antenna which can increase a radiation efficiency of an electromagnetic wave signal radiated from an antenna embedded in the wireless telecommunication terminal by the electromagnetic wave signal radiated from the whip antenna and extending a bandwidth by using a whip having independent power feeding in a wireless telecommunication terminal and separately feeding a whip antenna drawn out of a wireless telecommunication terminal.

BACKGROUND ART

The wireless telecommunication terminal mentioned in the present invention is a terminal that can be carried by a user portably and capable of wireless communication, such as Personal Communication Service (PCS), Personal Digital Assistant (PDA), Smart Phone, International Mobile Telecommunication-2000 (IMT-2000) and a wireless Local Area Network (LAN) terminal. The embodiments of the present invention will be described hereinafter by taking an example of a folder-type wireless telecommunication terminal. A value $\lambda_0$ is the wave length of an electromagnetic wave signal of a resonance frequency band radiated from each radiator.

Recently, wireless telecommunication terminals become miniaturized, as an integration technology of high frequency devices and a wireless telecommunication technology develop.

In particular, the size of an antenna for transmitting and receiving radio signals has been miniaturized according to the miniaturization trend of the wireless telecommunication terminal.

The antenna transforms an electric signal expressed as voltage/current into the electromagnetic wave signal and vice versa. That is, the antenna detects the electromagnetic wave signal radiated in the outside, i.e. free space, through an electromagnetism formed on a conductive wire, transforms the signal into the electric signal, resonates the electric signal from an end of the conductive wire into a particular frequency band, transforms the electric signal into an electromagnetic wave signal and radiates it to the outside.

The antenna is used for both transmission and reception of the wireless signal. That is, the antenna is so manufactured so as to fit characteristics of a particular frequency band in a planning or a manufacturing process. If the antenna is mounted in a transmit device for transmitting radio signals, it becomes a transmitting antenna. If it is set up in a wireless signal receiving device, it becomes a receiving antenna. If it is set up in a wireless signal transmitting/receiving device, it becomes a transceiving antenna.

Thus, if the antenna can transform an electric signal into an electromagnetic wave signal and radiate the signal to the outside, it is apparent that the antenna can transform the electromagnetic wave signal into the electric signal. Therefore, the embodiment of the present invention will be described only on the operation that an antenna transforms an electric signal into an electromagnetic wave signal and radiates the signal to the outside.

Meanwhile, a recent tendency is to mount a small antenna, so-called an intenna, in the inside of a wireless telecommunication terminal in order to make the exterior of the terminal beautiful.

FIG. 1 is a perspective view showing a conventional wireless telecommunication terminal with a built-in antenna.

As shown in FIG. 1, an embedded antenna 11 is mounted in upper one side of the inside of a body 10 in the wireless telecommunication terminal with the embedded antenna.

Although not shown in the drawing, the embedded antenna 11 is formed in such a manner that a plurality of radiators or conductive wires are connected to one feed point receiving an electric signal generated in the inside to process multi-frequency band signals.

FIG. 2 is a graph showing Voltage Standing Wave Ratio (VSWR) of the embedded antenna in a conventional wireless telecommunication terminal.

As shown in FIG. 2, in the frequency band 800 MHz of a Code Division Multiple Access (CDMA) method, VSWR values 20 and 21 are about 2.1:1 to 4.2:1, and the loss is serious in transmitting a signal due to the deterioration of impedance matching. This signifies that the antenna has poor performance.

Also, in the frequency band 1,800 to 1,900 MHz of a U.S. personal communication service (USPCS) method, the VSWR values 22 and 23 are about 2.4:1 to 3.0:1. This also shows that the antenna has poor performance.

A referential numeral 24 is a VSWR value in the frequency band 1,575 MHz of a Global Positioning System (GPS) method, which is 1.6:1.

Herein, the lower the Standing Wave Ratio of the antenna becomes, that is, the deeper a valley is formed in the graph becomes, the better an electric signal of the corresponding frequency band can flow on the conductive wire, thereby increasing the radiation efficiency of the electromagnetic wave signal.

However, since the antenna is embedded into the inside of the wireless telecommunication terminal in the conventional technology, the reflection and the refraction of the electromagnetic wave are caused by a metallic medium around a case and an antenna, which makes it difficult to radiate the electromagnetic wave signal intensely. Also, the narrow inner space of the wireless telecommunication terminal makes it difficult to radiate the electromagnetic wave signal having the multi-frequency band characteristics efficiently.

In particular, the conventional method has a problem that it is very difficult to radiate the electromagnetic wave signal of the multi-frequency band efficiently since the electromagnetic wave signal of a resonance frequency band having multi-frequency band characteristics has weak energy.

Also, the antenna is generally used in the VSWR range of 1.5. However, the problem of the conventional antenna is that the frequency bandwidth that can be embodied in the VSWR range of about 1.5 is too narrow.

DISCLOSURE

Technical Problem

To solve the problems of conventional technology, the present invention provides the following technology.

First, a minimum-sized embedded antenna and a monopole-type whip antenna that can process signals of a multi-frequency band such as Code Division Multiple Access (CDMA), Global Positioning System (GPS) and U.S. personal communication service (USPCS) simultaneously are embodied.

Second, the radiation efficiency of a frequency band signal, e.g., 800 MHz to 2,200 MHz, corresponding to the embedded antenna is improved by separately feeding the whip antenna.

Third, the range of the frequency band available in the embedded antenna such as a tri-band and a quad-band is widened by separately feeding the whip antenna.

Fourth, the embedded antenna is operated independently without any effects from the whip antenna set up in the inside of the wireless telecommunication terminal.

Fifth, the radiant efficiency of the frequency band signal, e.g., 800 MHz to 2,200 MHz, is improved by coupling particular radiators in the embedded antenna.

Sixth, the embedded antenna is prevented from deterioration in the frequency band by using a central feeding method and a short circuit network.

The present invention proposed to solve the problems provides a multi-band antenna using the whip having independent power feeding in the wireless telecommunication terminal, the antenna that can separately feed the whip antenna drawn out of the wireless telecommunication terminal, increase the radiant efficiency of the electromagnetic wave signal radiated from the antenna embedded in the wireless telecommunication terminal based on the electromagnetic wave signal radiated from the whip antenna, and extend a bandwidth.

Technical Solution

In accordance with one aspect of the present invention, there is provided a multi-band antenna using a whip having independent power feeding in a wireless telecommunication terminal, the antenna including: a first feed point for feeding an electric signal provided from an electric signal provider; a second feed point for feeding an electric signal provided from the electric signal provider; a plurality of radiators for radiating the electric signal fed from the first feed point in a form of an electromagnetic wave signal; and a whip radiator for radiating the electric signal fed from the second feed point in a form of an electromagnetic wave signal in order to increase the radiant efficiency of the electromagnetic wave signal radiated from the radiator and extend a bandwidth when the ship radiator is drawn out of the wireless telecommunication terminal.

Advantageous Effects

The present invention feeds a whip antenna separately with an embedded antenna, and increases a size of an electromagnetic wave signal radiated from the embedded antenna by the electromagnetic wave signal radiated from the whip antenna or improves an output impedance, which makes it possible to communicate efficiently without any performance deterioration of the embedded antenna even in the area of a weak frequency.

The present invention feeds the whip antenna separately with the embedded antenna, and extends a bandwidth of the electromagnetic wave signal radiated from the embedded antenna by the electromagnetic wave signal radiated from the whip antenna, which can extend a range of a frequency band available.

Also, the present invention can improve an output impedance of the electromagnetic wave signal of a specific resonance frequency band by the coupling of the specific radiators of the embedded antenna.

Also, the present invention supplies the electric signal to a radiator of the embedded antenna by the central feeding method and uses a short circuit network, which can prevent a deterioration of the electromagnetic wave signal of the specific resonance frequency band.

Also, the present invention can improve the performance of the embedded antenna by using the whip antenna drawn out of a wireless telecommunication terminal, thereby loading a small-sized embedded antenna to the wireless telecommunication terminal efficiently, which can reduce the difficulty for acquiring a space.

DESCRIPTION OF DRAWINGS

The above and other objects and features of the present invention will become apparent from the following description of the preferred embodiments given in conjunction with the accompanying drawings, in which.

BEST MODE OF THE INVENTION

Other objects and aspects of the invention will become apparent from the following description of the embodiments with reference to the accompanying drawings, which is set forth hereinafter.

An embedded antenna for a triple frequency band supporting the frequency bands of a Code Division Multiple Access (CDMA) method, a U.S. personal communication service (USPCS) method and a Global Positioning System (GPS) method, which is mounted in a wireless telecommunication terminal, will be described as an embodiment of the present invention. While the present invention has been described with respect to certain preferred embodiments, it will be apparent to those skilled in the art that the invention is not limited to the embodiments, but generally applied to all wireless telecommunication terminals using a high frequency band such as a single frequency band, or a multiple frequency band more than three.

Figure 1:
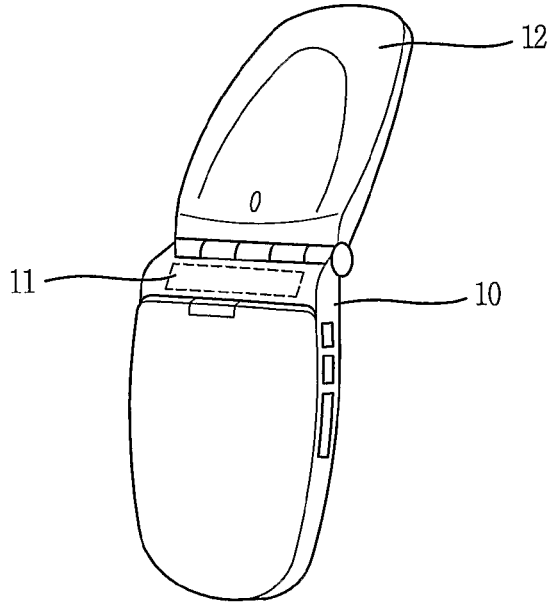
FIG. 1 (PRIOR ART)
FIG. 1 is a perspective diagram illustrating a conventional wireless telecommunication terminal with an embedded antenna.
Figure 2:
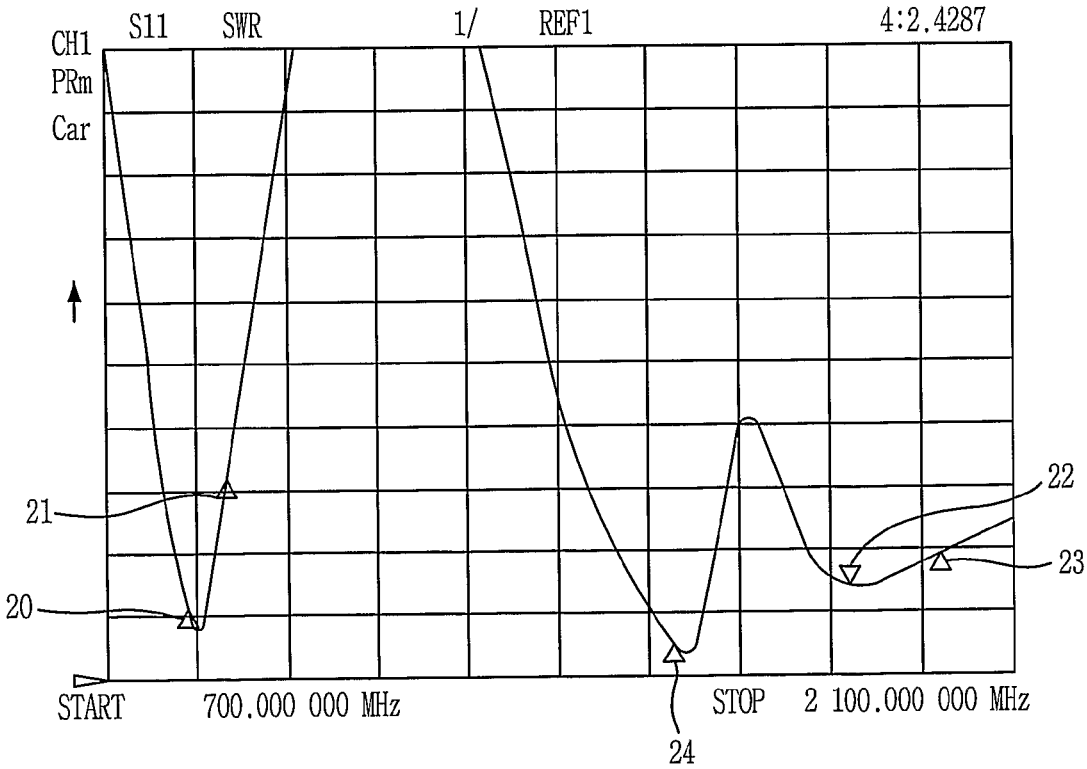
FIG. 2 (PRIOR ART)
FIG. 2 is a graph showing Voltage Standing Wave Ratio (VSWR) of an embedded antenna in a conventional wireless telecommunication terminal.
Figure 3:
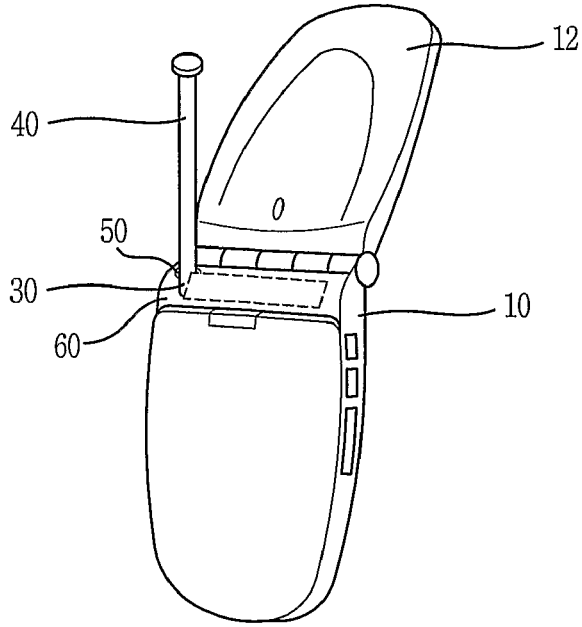
FIG. 3 is a perspective view showing the wireless telecommunication terminal with a multi-band antenna using a whip having independent power feeding in accordance with an embodiment of the present invention.

FIG. 3 is a perspective view showing the wireless telecommunication terminal with a multi-band antenna using a whip having independent power feeding in accordance with an embodiment of the present invention.

As shown in FIG. 3, the embedded antenna 30 is mounted in the upper one side of the inside of a body 10, and a led-penetrating opening 50 is formed in the upper one side of the body 10. While a whip antenna 40 is mounted in the led-penetrating opening 50 in the wireless telecommunication terminal mounting the multi-band antenna using the whip having independent power feeding.

A conductive wire is included in the inside of the whip antenna 40 and covered with an insulator. Also, a contact band (not shown) which is connected to the conductive wire is formed in the circumference of the lower part of the insulator of the whip antenna 40.

In addition, the whip antenna 40 is mounted in the led-penetrating opening 50, and drawn in and out of the wireless telecommunication terminal.

Meanwhile, the embedded antenna 30 is firmly attached to inner one side of a plastic material frame 60 such as-an injection molding and a carrier, and mounted in upper one side of the wireless telecommunication terminal frame 10. The led-penetrating opening 50 is firmly attached to the side of the frame 60 and mounted in upper one side of the wireless telecommunication terminal body 10. The structure of the frame 60 will be described in detail referring to FIG. 4 hereinafter.

Figure 4:
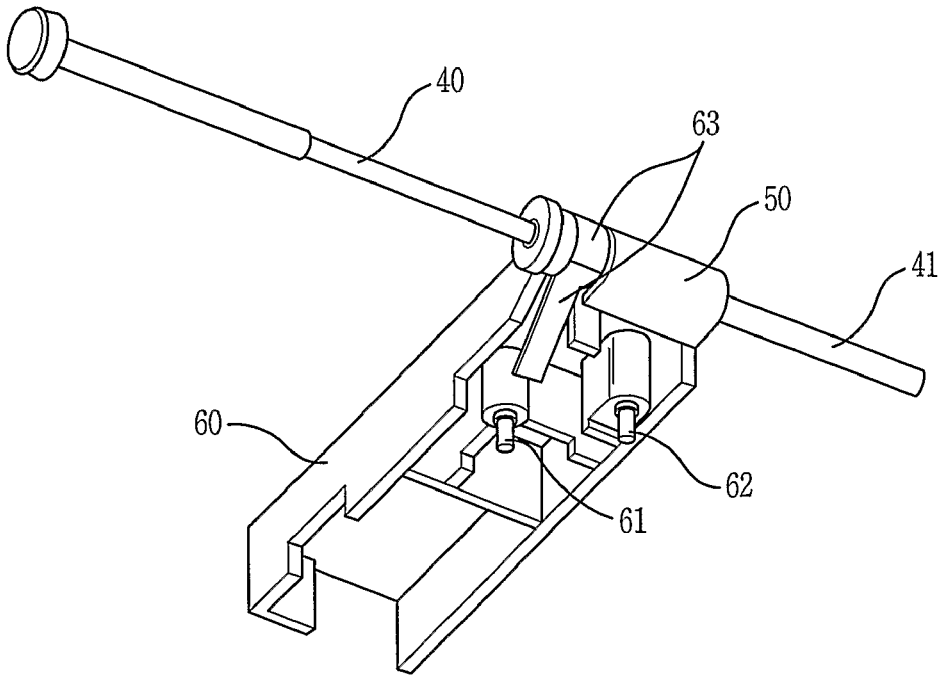
FIG. 4 is a perspective view showing a frame for mounting the multi-band antenna using the whip having independent power feeding on the wireless telecommunication terminal in accordance with an embodiment of the present invention.

FIG. 4 is a perspective view showing a frame for mounting the multi-band antenna using the whip having independent power feeding on the wireless telecommunication terminal in accordance with an embodiment of the present invention.

As shown in FIG. 4, a first contact point 61 connected to a first feed point is formed on a printed circuit board (not shown) inside the wireless telecommunication terminal, and a short circuit point 62 connected to a ground surface is formed on the printed circuit board are formed in the inside of the frame 60 for mounting the multi-band antenna using the whip having independent power feeding in the wireless telecommunication terminal.

The embedded antenna 30 is firmly attached to the opening formed in the inside of the frame 60, which is not shown in the drawing.

Herein, one side of the embedded antenna 30 is connected to the first contact point 61, and receives the electric signal provided from an electric signal provider (not shown) of the wireless telecommunication terminal through the first feed point and the contact point 61 all the times.

A contact pin 63 connected to a second feed point formed on the printed circuit board inside the wireless telecommunication terminal is formed in the led-penetrating opening 50 which is firmly attached to one side of the frame 60. One side of the contact pin 63 is connected to the second feed point and the other side covers the inner girth of the led-penetrating opening 50.

Herein, since the whip antenna 40 is partly drawn out of the wireless telecommunication terminal through the led-penetrating opening 50, the contact band 41 formed in the girth below the whip antenna 40 is connected to the contact pin 63. Thus, the whip antenna 40 receives the electric signal provided by the electric signal provider of the wireless telecommunication terminal through the second feed point and the contact pin 63.

The contact band 41 is formed by winding the conductive conductor in a shape of band in one side of the whip antenna 40 or inserting it into the lower part of the whip antenna 40.

Conversely, if the whip antenna 40 receiving the electric signal through the contact pin 63 is partly led into the inside of the wireless telecommunication terminal, the contact between the contact band 41 and the contact pin 63 is cut off. Thus, the whip antenna 40 cannot receive the electric signal from the electric signal provider of the wireless telecommunication terminal.

Meanwhile, a plurality of female openings are formed in one edge of the frame 60.

The frame 60 is firmly attached to upper one side of the body 10 by joining the female openings with a plurality of male openings, such as screws, and firmly attached to upper one side of the body 10 of the wireless telecommunication terminal.

Figure 5:
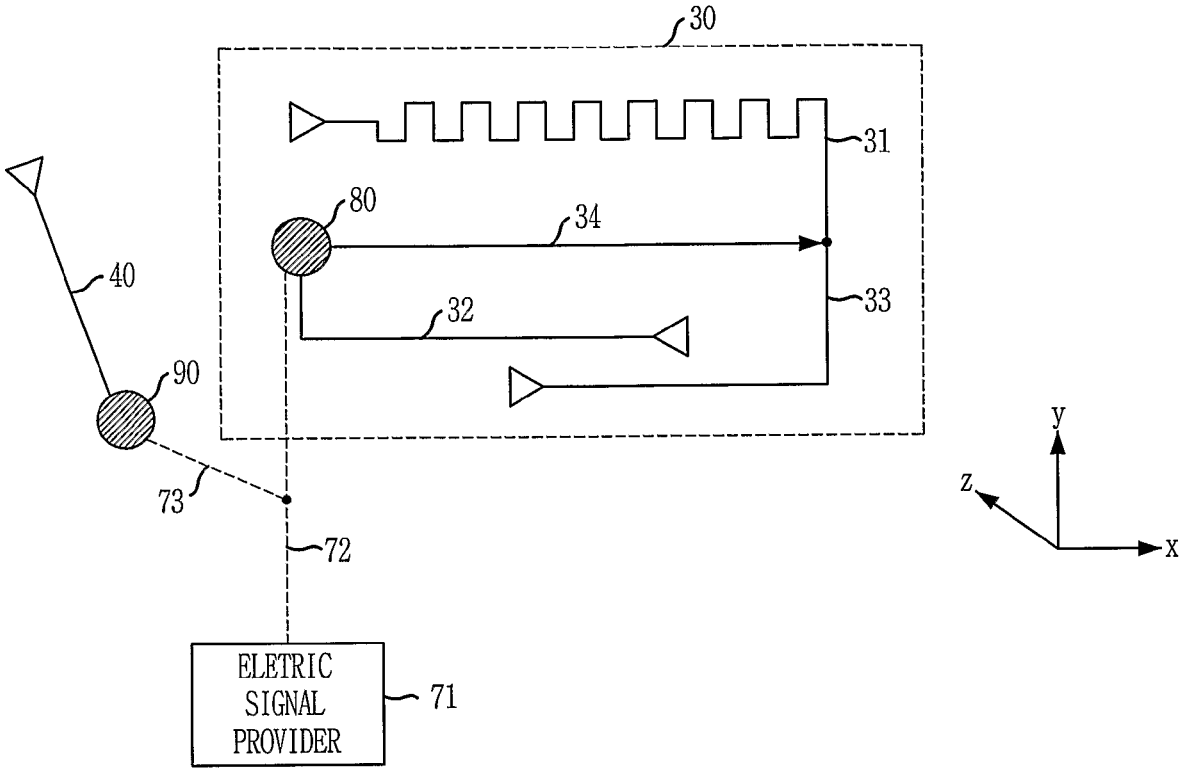
FIG. 5 is a schematic diagram showing a multi-band antenna using the whip having independent power feeding in the wireless telecommunication terminal in accordance with an embodiment of the present invention.

FIG. 5 is a schematic diagram showing a multi-band antenna using the whip having independent power feeding in the wireless telecommunication terminal in accordance with an embodiment of the present invention.

As shown in FIG. 5, the multi-band antenna using the whip having independent power feeding in the wireless telecommunication terminal in accordance with the present invention includes a first feed point 80 for receiving an electric signal provided from an electric signal provider 71 through a first transmission line 72 and feeding the signal to the embedded antenna 30, a second feed point 90 for receiving an electric signal provided from the electric signal provider 71 through a second transmission line 73 and feeding the signal to the whip antenna 40, an embedded antenna 30 for radiating the electric signal fed from the first feed point 80 into an electromagnetic wave signal, and the whip antenna 40 for radiating the electric signal fed from the second feed point 90 into an electromagnetic wave signal in order to increase the radiant efficiency of the electromagnetic wave signal radiated from the embedded antenna 30 and extend the bandwidth.

The embedded antenna 30 includes a first radiator 31 for radiating the electric signal fed from the first feed point 80 in a form of an electromagnetic wave signal of the frequency band, e.g., 800 MHz, a second radiator 32 for radiating the electric signal fed from the first feed point 80 in a form of the electromagnetic wave signal of the USPCS frequency band, e.g., 1,800 MHz, and a third radiator 33 for radiating the electric signal fed from the first feed point 80 in a form of an electromagnetic wave signal of the GPS frequency band, e.g., 1,575 MHz.

The embedded antenna 30 further includes a common line 34 for dividing the electric signal fed from the first feed point 80 and transmitting each signal to the first radiator 31 and the third radiator 33.

The whip antenna 40 is embodied in a form of a monopole-type antenna radiating the electromagnetic wave signal resonating in the frequency band of 1 GHz.

The first feed point 80, the second feed point 90, the first transmission line 72 and the second transmission line 73 are embodied on the printed circuit board of the wireless telecommunication terminal.

The second feed point 90 is embodied so as to receive the electric signal through the second transmission line 73 diverged from the first transmission line 73 from the electric signal provider 71 to the first feed point 80

The present invention embodies the first feed point 80 and the second feed point 90 for feeding electric signals to the antenna, and has the whip antenna 90 fed directly by the electric signal fed by the second feed point 90. Although it is possible to make the electric signal simultaneously fed into the embedded antenna 30 and the whip antenna 40 through one feed point, it is not a separate feeding, but it is a method extending the embedded antenna to the outside through the feed point.

Since the whip antenna 40 is drawn to the outside through the led-penetrating opening 50, the electric signal fed from the second feed point 90 is radiated into the electromagnetic wave signal. Thus the electromagnetic wave signal of the resonance frequency band radiating in the whip antenna 40 helps increasing the energy, i.e., size, of the electromagnetic field in the electric signal of the resonance frequency band radiated from the embedded antenna 30 in accordance with the present invention.

Since the whip antenna 40 is drawn into the inside of the wireless telecommunication terminal, the supply of electric signals from the second feed point 90 is cut off in accordance with the present invention. If the whip antenna is drawn out of the wireless telecommunication terminal, both of the whip antenna 40 and the embedded antenna 30 perform their own function, otherwise if the whip antenna 40 is drawn into the inside of the wireless telecommunication terminal, only the embedded antenna 30 performs its function in accordance with the present invention.

Figure 6:
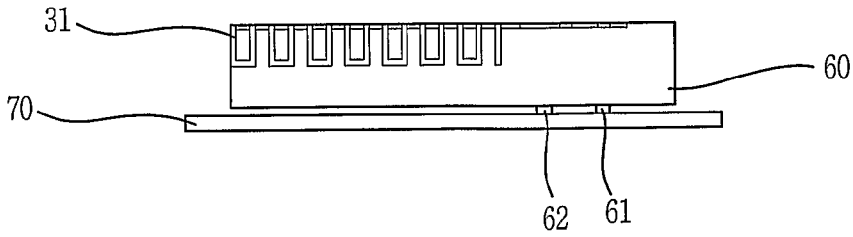
FIG. 6 is a plane view showing an embedded antenna of a multi-band antenna using a whip having independent power feeding in the wireless telecommunication terminal in accordance with an embodiment of the present invention.
Figure 7:
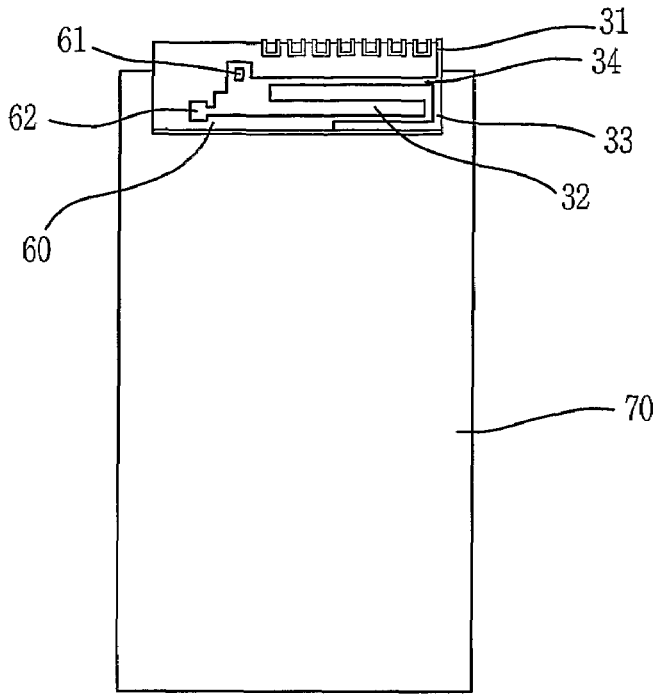
FIG. 7 is a side view illustrating the embedded antenna of the multi-band antenna using the whip having independent power feeding in the wireless telecommunication terminal in accordance with the embodiment of the present invention.

FIG. 6 is a plane view showing an embedded antenna of a multi-band antenna using a whip having independent power feeding in the wireless telecommunication terminal in accordance with an embodiment of the present invention, and FIG. 7 is a side view illustrating the embedded antenna of the multi-band antenna using the whip having independent power feeding in the wireless telecommunication terminal in accordance with the embodiment of the present invention.

As shown in FIGS. 6 and 7, the frame 60 with the embedded antenna 30 mounted thereon in the upper part of the printed circuit board 70 (PCB) is connected to the inside of the wireless telecommunication terminal.

A short circuit point 62 formed in the frame 60 is connected to the ground surface on the printed circuit board 70 and a contact point 61 formed in the frame 60 is connected to the first feed point 80 on the printed circuit board 70.

One side of the common line 34 is connected to the first fed point 80 through the contact point 61 and transmits the electric signal fed from the first feed point 80 to an end on the other side of a straight line. Herein, each electric signal transmitted from the first feed point 80 is divided into the first radiator 31 and the third radiator 33 and transmitted separately.

The first radiator 31 is diverged from an end of the common line 34 to the inner upper side of the wireless telecommunication terminal and arrayed in a meander line. Herein, since the first radiator 31 is arrayed in the meander line, it can have an inductance component for itself and offset a capacitance component by a human hand, which can improve the performance of the antenna.

Also, the first radiator 31 transmits the electric signal divided from the common line 34 to the opposite way of the electric signal of the common line 34.

One side of the second radiator 32 is connected to the first feed point 80 through the contact point 61 and transmits the electric signal fed from the first feed point 80 to an end on the other side of a straight line following the way of the electric signal direction of the common line 34.

The third radiator 33 is diverged from the end of the common line 34 to an inner lower side of the wireless telecommunication terminal, and transmits the electric signal divided in the common line 34 to the opposite side of the electric signal direction of the common line 34.

The third radiator 33 transmits the electric signal divided from the common line 34 to the opposite way of the electric signal of the second radiator 32, and is arrayed in a predetermined distance from the second radiator 32, e.g., 0.03 mm. Thus, a coupling between the electric signals transmitted from the second radiator 32 and the third radiator 33 occurs and the energy of the electromagnetic wave signal of the resonance frequency band increases, which improves the performance of the antenna.

Meanwhile, the first radiator 31 is embodied as a conductive wire having a physical length corresponding to the electric length of $0.4\lambda_0$ and the width of $0.0014\lambda_0$ with respect to the resonance frequency band.

The second radiator 32 is embodied as a conductive wire having the physical length corresponding to the electric length of $0.27\lambda_0$ and the width of $0.0053\lambda_0$ with respect to the resonance frequency band.

The third radiator 33 is embodied as a conductive wire having the physical length corresponding to the electric length of $0.18\lambda_0$ and the width of $0.0128\lambda_0$ with respect to the resonance frequency band.

Meanwhile, each of the first to third radiators 31 to 33 is embodied as a conductive wire of nickel-plated copper, a tin-plated copper or a beryllium-copper material.

Also, the electric length and the width of the first radiator to the third radiator 31 to 33 are changed according to the resonance frequency band and determined based on the experiment value.

Figure 8:
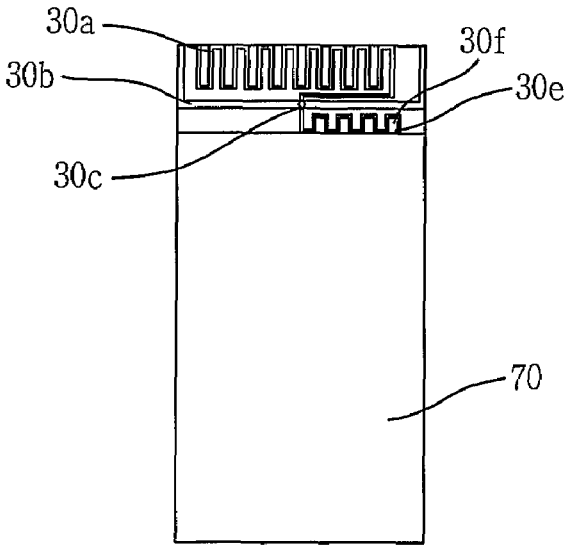
FIG. 8 is a side view describing an embedded antenna of a multi-band antenna using a whip having independent power feeding in a wireless telecommunication terminal in accordance with another embodiment of the present invention.

FIG. 8 is a side view describing an embedded antenna of a multi-band antenna using a whip having independent power feeding in a wireless telecommunication terminal in accordance with another embodiment of the present invention.

As shown in FIG. 8, the embedded antenna of the multi-band antenna using the whip having independent power feeding in the wireless telecommunication terminal, which is suggested in accordance with the present invention, is formed in the center of right and left of the inner upper side of the wireless telecommunication terminal, and it includes a third feed point 30*c* for feeding the electric signal fed from the electric signal provider 71 to each constitutional element, a fourth radiator 30*a* for radiating the electric signal fed from the third feed point 30*c* in a form of an electromagnetic wave signal of the CDMA frequency band, such as 800 MHz, a fifth radiator 30*b* for radiating the electric signal fed from the third feed point 30*c* as the electromagnetic wave signal of the GPS frequency band such as 1,575 MHz, the short circuit pin 30*e* for grounding a short circuit network 30*f* and the short circuit network 30*f* which is formed between the third feed point 30*c* and the short circuit pin in the same length as the fifth radiator 30*b* for radiating the part of the electric signal feeding in the third feed point 30*c* as the electromagnetic wave signal.

The inner circuit board (ground surface) 70 of the wireless telecommunication terminal and the short circuit pin 30*e* for the antenna ground are connected in the embedded antenna, and the short circuit network 30*f* having the same length as the fifth radiator 30*b* is formed between the third feed point 30*c* and the short circuit pin 30*e*, thereby radiating the part of the electric signal fed from the third feed point 30*c* in a form of an electromagnetic wave signal.

That is, the third feed point 30*c* can have an enough resonance length in the embedded antenna by being positioned in the right and left center of the ground surface instead of an end of the antenna differently from the conventional antenna.

One side of the fourth radiator 30*a* and one side of the fifth radiator 30*b* are connected to the third feed point 30*c*, and the other sides of the radiators 30*a* and 30*b* are arrayed in the same direction. Therefore, the electric signal flows in a same direction in the radiators 30*a* and 30*b*. Thus the offset electric current component is minimized and a reinforcement interference occurs between the radiators 30*a* and 30*b*.

The fourth radiator 30*a* is diverged from the third feed point 30*c* to the upper side of the inside of the wireless telecommunication terminal and arrayed in a meander line in one way of the inner upper part of the wireless telecommunication terminal.

The fifth radiator 30*b* is embodied to be diverged in both left and right directions centering the third feed point 30*c*. Thus the electromagnetic wave signal of the frequency GPS band is allotted to the opening inside of the wireless telecommunication terminal and the omni-directional electromagnetic wave signal radiation becomes available.

The short circuit network 30*f* is diverged from the third feed point 30*c* to the inner lower side of the wireless telecommunication terminal and arrayed in a meander line in one direction toward the inner lower part of the wireless telecommunication terminal.

Meanwhile, the fourth radiator 30*a*, the fifth radiator 30*b* and the short circuit network 30*f* are separately embodied to be a conductive wire having the width of $1.5\times10^{-3}\lambda_0$ with respect to the resonance frequency band. Also, the fourth radiator 30*a* has a meandering space of $2.0\times10^{-3}\lambda_0$ and the total length of $0.7\lambda_0$. The fifth radiator 30*b* and the short circuit network 30*f* have a length of $0.35\lambda_0$.

Meanwhile, the fourth radiator 30*a*, the fifth radiator 30*b* and the short circuit network 30*f* are embodied in a form of a conductive wire of a nickel-plated copper having a thickness of $0.6\times10^{-3}\lambda_0$, individually.

Meanwhile, the fourth radiator 30*a*, the fifth radiator 30*b* and the short circuit network 30*f* are respectively embodied in a form of a copper tape or a flexible PCB preventing the erosion of a surface by coating the surface with the low voltage injection device.

Figure 9:
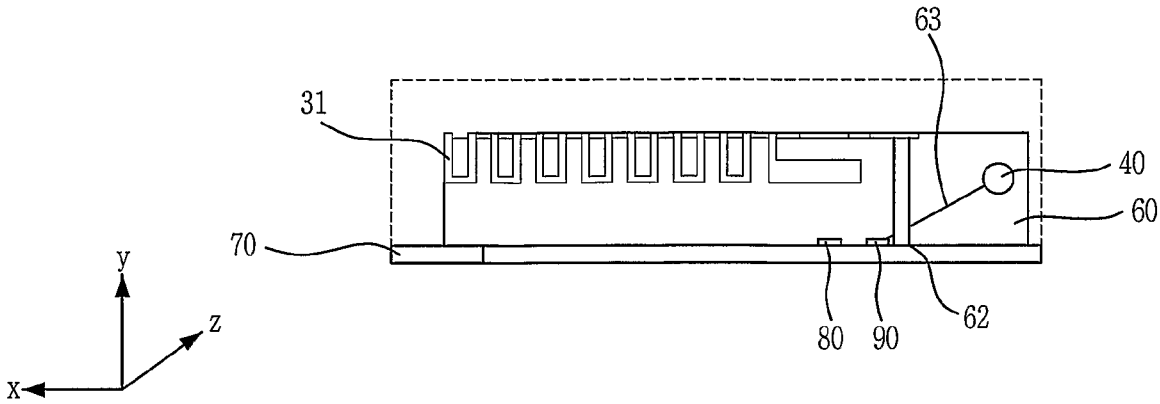
FIG. 9 is a plane view showing a multi-band antenna using a whip having independent power feeding in a wireless telecommunication terminal in accordance with an embodiment of the present invention.
Figure 10:
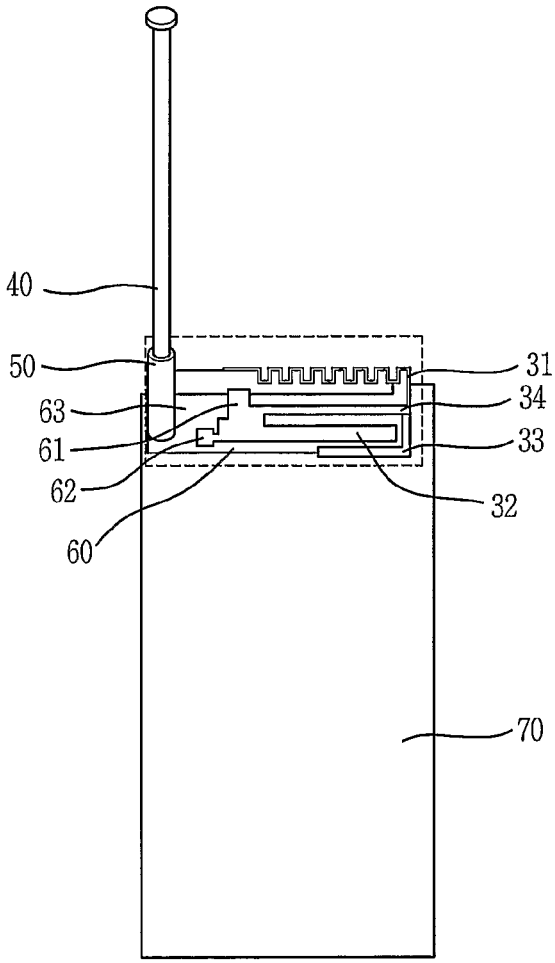
FIG. 10 is a side view showing the multi-band antenna using the whip having independent power feeding in the wireless telecommunication terminal in accordance with the embodiment of the present invention.

FIG. 9 is a plane view showing a multi-band antenna using a whip having independent power feeding in a wireless telecommunication terminal in accordance with an embodiment of the present invention, and FIG. 10 is a side view showing the multi-band antenna using the whip having independent power feeding in the wireless telecommunication terminal in accordance with the embodiment of the present invention.

As shown in FIGS. 9 and 10, if the whip antenna 40 is drawn out of the wireless telecommunication terminal, the contact band 41 formed in one side of the lower part of the whip antenna 40 is connected to the one side of the contact pin 63 in the inside of the frame 60 which is connected to the second feed point 90.

The whip antenna 40 receives the electric signal from the second feed point 90 through the contact pin 63 and the contact band 41 and radiates the electromagnetic wave signal of the resonance frequency band.

Accordingly, the size of the electromagnetic wave signal of the resonance frequency band radiating in the embedded antenna 30 is enlarged and the bandwidth is extended.

Conversely, if the whip antenna 40 is drawn into the inside of the wireless telecommunication terminal, the contact between the pre-connected contact band 41 and the contact pin 63 is disconnected.

Accordingly, the whip antenna 40 does not carry out the function radiating the electromagnetic wave signal due to the shutoff of the electric signal supply from the second feed point 90. Herein, only the embedded antenna 30 carries out the function.

That is, the whip antenna 40 does not radiate the electromagnetic wave signal by being drawn into the inside of the wireless telecommunication terminal, the coupling between the antenna 30 and 40 does not occur since the whip antenna 40 is separated from the embedded antenna 30.

The whip antenna 40 is embodied in a form of a conductive wire having the length of 60 mm and the external diameter of 0.7Φ.

Figure 11:
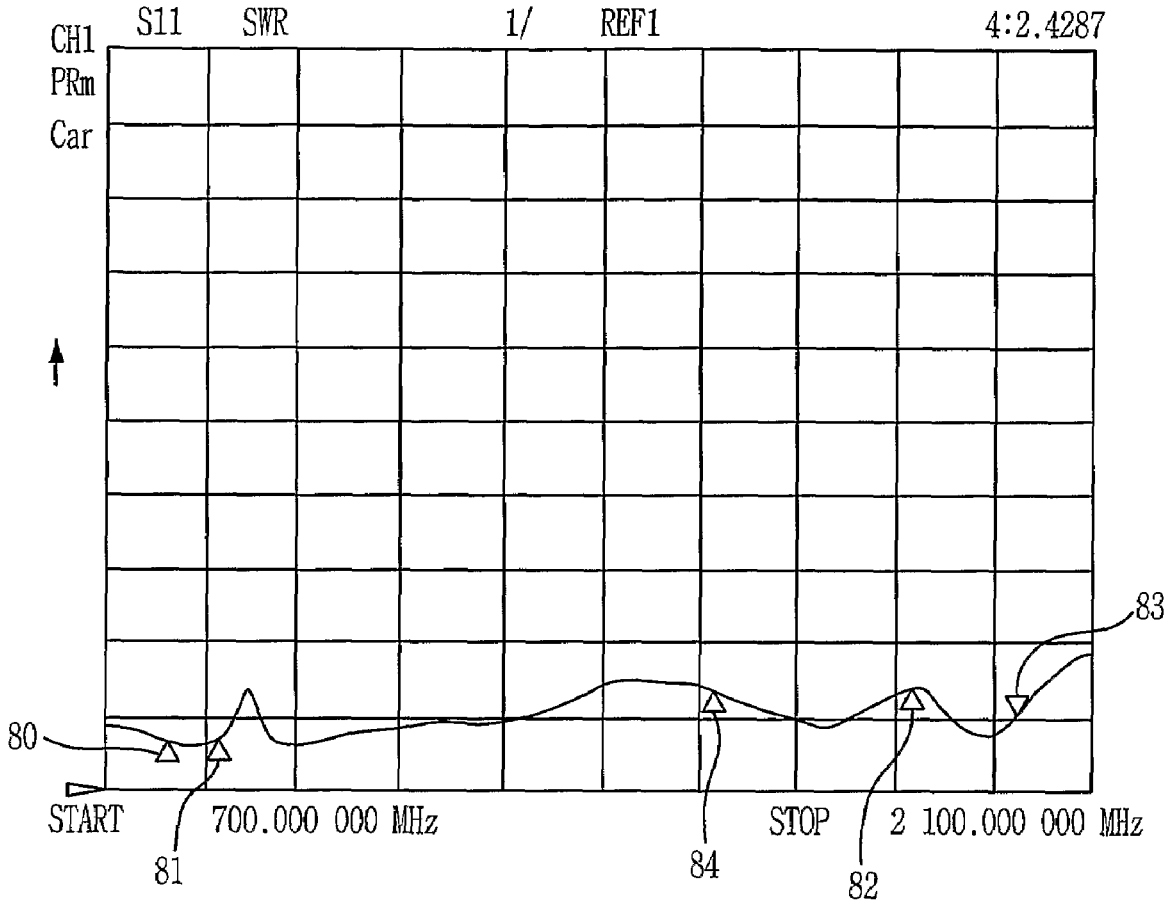
FIG. 11 is a graph showing a VSWR of the multi-band antenna using the whip having independent power feeding in the wireless telecommunication terminal in accordance with the embodiment of the present invention.

FIG. 11 is a graph showing a VSWR of the multi-band antenna using the whip having independent power feeding in the wireless telecommunication terminal in accordance with the embodiment of the present invention.

As shown in FIG. 11, the values 80 and 81 of Voltage Standing Wave Ratio are about 1.7:1 in the CDMA frequency band 800 MHz, and this shows that the radiant efficiency is increased compared with the conventional method. Since the frequency bandwidth of the CDMA method is extended, the performance of the antenna is improved.

Also, the VSWR values 82 and 83 are improved in the USPCS frequency band, which is 1,800 MHz to 1,900 MHz, compared with the conventional method.

The reference numeral 84 means the VSWR value of the GPS frequency band, which is 1,575 MHz.

Also, the VSWR value is about 1.6:1 to 2.5:1 in the entire frequency band from 700 MHz to 2 GHz, which means that the impedance matching characteristics and the radiant efficiency are improved in the entire frequency bands. Therefore, since the frequency bandwidth of each telecommunication method such as CDMA, GPS and USPCS is extended and the telecommunication is possible in the bandwidth which was not available in the conventional antenna, the multi-band can be realized.

In addition, a graph showing the VSWR of the multi-band antenna with the embedded antenna prescribed with reference to FIG. 8 and using the whip having independent power feeding is not shown, but it is apparent that the VSWR value is improved in the CDMA frequency band, which is 800 MHz.

While the present invention has been described with respect to certain preferred embodiments, it will be apparent to those skilled in the art that various changes and modifications may be made without departing from the scope of the invention as defined in the following claims.

What is claimed is:

1. A multi-band antenna using a whip having an independent power feeding function in a wireless telecommunication terminal, comprising:

a first feed point for feeding an electric signal provided from an electric signal providing means;

a second feed point for feeding an electric signal provided from the electric signal providing means;

a plurality of radiating means for radiating the electric signal fed from the first feed point in a form of an electromagnetic wave signal; and a whip radiating means for radiating the electric signal fed from the second feed point in a form of an electromagnetic wave signal in order to increase the radiant efficiency of the electromagnetic wave signal radiated from the radiating means and extend a bandwidth when the whip radiating means is drawn out of the wireless telecommunication terminal, wherein the second feed point feeds by receiving the electric signal through a separate second transmission line diverged from a first transmission line providing the electric signal from the electric signal providing means to the first feed point.

2. The antenna as recited in claim 1, wherein the whip radiating means is drawn into the wireless telecommunication terminal, thereby shutting off the electric signal supply fed in the second feed point.

3. The antenna as recited in claim 1, wherein as part of the whip radiating means is drawn out of the wireless telecommunication terminal, a first contact member formed in one side of the lower part of the whip radiating means contacts with the second feed point through a second contact member in a frame.

4. The antenna as recited in claim 3, wherein as part of the whip radiating means is drawn into the wireless telecommunication terminal, the connection between the first contact member formed in one side of the lower part of the means and the second contact member is disconnected, and thus, the contact with the second feed point is cut off.

5. The antenna as recited in claim 1, wherein the whip radiating means is a monopole-type antenna radiating an electromagnetic wave signal resonating in 1 GHz frequency band.

6. The antenna as recited in claim 1, wherein the whip radiating means is put into a led-penetrating opening formed in one side of the upper part of the wireless telecommunication terminal, and drawn in and out of the wireless telecommunication terminal.

7. The antenna as recited in claim 1, further comprising: a diverging means for diverging the electric signal fed in the first feed point and transmitting into the radiating means among a plurality of radiating means.

8. The antenna as recited in claim 7, wherein a multiple number of radiating means includes:

a first radiating means for receiving the electric signal fed in the first feed point through the diverging means and radiating the electric signal in a form of an electromagnetic wave signal of a Code Division Multiple Access (CDMA) frequency band;

a second radiating means for radiating the electric signal fed in the first feed point in a form of an electromagnetic wave signal of a U.S. personal communication service (USPCS) frequency band; and a third radiating means for receiving the electric signal fed in the first feed point through the diverging means and radiating the signal in a form of an electromagnetic wave signal of a Global Positioning System (GPS) frequency band.

9. The antenna as recited in claim 8, wherein the first radiating means is diverged from an end of the diverging means to the upper part of the inside of the wireless telecommunication terminal, arrayed in a form of a meander line toward a direction of the upper side of the inside of the wireless telecommunication terminal, and radiates electric signals divided in the diverging means in a direction opposite to the direction of the electric signal of the diverging means.

10. The antenna as recited in claim 8, wherein the first radiating means is a conductive wire having a width of $0.0014\lambda_0$ and a physical length corresponding to an electric length of $0.4\lambda_0$ with respect to a corresponding resonance frequency band;

the second radiating means is a conductive wire having a width of $0.0053\lambda_0$ and a physical length corresponding to an electric length of $0.27\lambda_0$ with respect to a corresponding resonance frequency band; and the third radiating means is a conductive wire having a width of $0.0128\lambda_0$ and a physical length corresponding to an electric length of $0.18\lambda_0$ with respect to a corresponding resonance frequency band.

11. The antenna as recited in claim 8, wherein each radiating means is attached to one side of the frame separately and mounted in one side of the upper part of the rear of the wireless telecommunication terminal.

12. The antenna as recited in claim 1, wherein the whip radiating means includes a conductive wire having a length of 60 mm and an external diameter of 0.7Φ.

13. The antenna as recited in claim 1, wherein each of the radiating means is a conductive wire of nickel plated copper, a conductive wire of tin-plated copper, or a conductive wire of beryllium-copper.

14. The antenna as recited in claim 1, wherein the first feed point is formed in the right and left center of the upper part in the wireless telecommunication terminal, and the radiating means includes:

a fourth radiating means for radiating the electric signal fed in the first feed point in a form of an electromagnetic wave signal of the CDMA frequency band;

a fifth radiating means for radiating the electric signal fed in the first feed point in a form of electromagnetic wave signal of the GPS frequency band;

a sixth radiating means for radiating the part of the electric signal fed in the first feed point in a form of electromagnetic wave signal; and a short circuit pin for grounding the sixth radiating means.

15. The antenna as recited in claim 14, wherein the fourth radiating means is diverged from the first feed point to the inner upper part of the inside of the wireless telecommunication terminal, and arrayed in a meander line in a direction toward one side of the upper part of the terminal.

16. The antenna as recited in claim 14, wherein the fourth radiating means is a conductive wire having a width of $1.5\times10^{-3}\lambda_0$ a thickness of $0.6\times10^{-3}\lambda_0$, and a length of $0.7\lambda$ with respect to a corresponding resonance frequency band;

the fifth radiating means is a conductive wire having a width of $1.5\times10^{-3}\lambda_0$, a thickness of $0.6\times10^{-3}\lambda_0$, and a length of $0.35\lambda$ with respect to a corresponding resonance frequency band; and the sixth radiating means is a conductive wire having a width of $1.5\times10^{-3}\lambda_0$, a thickness of $0.6\times10^{-3}\lambda_0$, and a length of $0.35\lambda$ with respect to a corresponding resonance frequency band.

17. The antenna as recited in claim 14, wherein the fourth radiating means has a meandering space of $2.0\times10^{-3}\lambda_0$.

18. The antenna as recited in claim 1, wherein each of the radiating means is embedded in a form of a copper tape or a flexible PCB preventing surface corrosion by coating the surface with a low voltage injection device.

* * * * *